United States Patent [19]

Poor

[11] Patent Number: 4,987,816

[45] Date of Patent: Jan. 29, 1991

[54] FINGERBOARD

[75] Inventor: Lane Poor, Warren, R.I.

[73] Assignee: The Sound Music Co., Inc., Fall River, Mass.

[21] Appl. No.: 399,156

[22] Filed: Aug. 28, 1989

[51] Int. Cl.[5] ..... G10D 3/06

[52] U.S. Cl. ..... 84/314 R

[58] Field of Search ..... 84/314 R

[56] References Cited

U.S. PATENT DOCUMENTS

| | | | |
|---|---|---|---|
| 2,816,469 | 12/1957 | Gossom | 84/314 R |
| 3,273,439 | 9/1966 | Keefe et al. | 84/314 R |
| 3,787,600 | 1/1974 | Muncy | 84/314 R |
| 4,064,780 | 12/1977 | Bond | 84/314 R |

FOREIGN PATENT DOCUMENTS

| | | | |
|---|---|---|---|
| 434357 | 2/1912 | France | 84/314 R |

*Primary Examiner*—Lawrence R. Franklin

*Attorney, Agent, or Firm*—Joseph S. Iandiorio; Brian M. Dingman

[57] ABSTRACT

An improved fingerboard for a stringed instrument having a series of substantially planar raised surfaces, each surface having an edge disposed toward the nut of the instrument, a "fret edge". The fret edges are located at fret positions along the strings and may be provided by the attachment of fret blocks to the fingerboard. Between the raaised surfaces are recessed surfaces which are at least partially inclined to verge upon the fret edges of the raised surfaces. Alternatively, the raised surfaces and recessed surfaces may be formed of a single monolithic member. The fingerboard is a modular unit which may be installed on the neck of the instrument or may comprise the neck of the instrument itself. Recessed surfaces may include indicator means to show the fret position of a proximate fret edge.

17 Claims, 3 Drawing Sheets

FINGERBOARD

FIELD OF INVENTION

This invention relates to a fingerboard for a stringed instrument and specifically to a fretless fingerboard which has a series of raised surfaces traversing the fingerboard with recessed finger stops.

BACKGROUND OF INVENTION

Stringed instruments such as the guitar and violin operate by tensioning a string between two points at opposite ends of the instrument known as the nut and the bridge. The string is suspended and tensioned between the nut and bridge and is plucked or otherwise vibrated to establish a standing wave which produces the sound perceived by the listener. The nut and bridge define terminal nodes of the standing wave and establish the wavelength of the standing wave defined by the vibration of the string. The frequency of the note produced by the string is, in part, a function of the distance between the string's terminal nodes. Commonly, stringed instruments include a fingerboard situated in longitudinal proximity to the strings, allowing the musician to press the string in contact with the fingerboard at a point between the nut and the bridge. The point of contact with the fingerboard establishes a new or substitute terminal node between the bridge and the nut at the point of contact, (referred to as a "stop") thereby changing the wavelength and frequency of the string's vibration in compliance with the effective length of the string between the bridge and the stop. Ordinarily, the nut defines a terminal node only when the string is sounded in the open position, i.e., without an intermediate stop established on the fingerboard. The bridge almost always defines a terminal node, wherever the string is stopped. Some instruments, like the violin, have fingerboards which are smooth and allow the musician to stop the string at any point on the fingerboard and thus produce an indefinite number of notes corresponding to an indefinite number of possible effective string lengths or "stop positions." Fingerboards of other instruments, like the guitar, have frets to establish predetermined stop positions for defining a finite series of predetermined effective string lengths and corresponding notes which the string may produce.

Conventional frets are made from wire which is cut into lengths corresponding to the width of the fingerboard and are usually partially inlaid into the fingerboard. The portion of the fret which protrudes from the fingerboard, at its uppermost point or apex, comes in contact with the string when the musician presses the string toward the fingerboard and thus determines the location of the stop on the string. The design of a well tempered instrument requires that the stop positions be at precise locations on the string in relation to the nut and bridge, referred to as "fret positions", which are spaced from one another by fret intervals. Fret intervals shorten as they ascend the neck toward the bridge of the instrument. Ideally, frets are designed and installed so that the stop positions coincide with fret positions on the strings.

The use of conventional frets adds significantly to the cost of manufacturing and maintaining a fretted instrument because there are typically more than a dozen such frets on the fingerboard of the instrument and their installation is a time-consuming process. In addition, when the instrument is used, the frets tend to wear at the point of contact with the string, causing the apex of the fret to become a flattened surface. Such wear may be the result of various techniques used by musicians to produce notes having frequencies corresponding to string lengths which do not coincide with fret positions. One such technique is to press the string into contact with the closest point of the fingerboard until the string is in contact with a fret and then to slide the string across the fret, thereby increasing the tension on the string and raising the frequency of the note produced. Alternatively, the musician may stretch the string before bringing it in contact with the fret and then sliding it on the fret back into a neutral position, known as "pull-on". In addition to causing wear, the sliding contact of the string on the fret often produces unwanted noise.

As a fret wears down, the stop position drifts from the fret position toward the nut, putting the instrument out of tune. Worn frets can be replaced, but the replacement process is costly and it damages the fingerboard of the instrument to such an extent that after several repairs the fingerboard or entire neck of the instrument must be replaced. Lately, these problems have been exacerbated because of the preference for the sound produced by bigger frets, referred to as the jumbo and super jumbo frets. These frets provide a superior physical impedance at the stops and provide the instrument with a greater sustain and preferred pull-on sound, but because of their bulk, they allow the stop position on the string as a result of wear to drift even further from the bridge than do conventional frets.

It is common for a musician to slide his fingers along a string in moving contact with the fret board to produce a sliding variation of the frequency produced by the string. Conventional frets give this sliding technique a choppy sound and irritate the musician's fingers.

One attempt to provide an improved fingerboard has been seen in which portions of the fingerboard between fret positions are inclined, giving the fingerboard a sawtooth longitudinal cross-section with the short jags of the sawtooth disposed toward the bridge of the instrument. The apex of each sawtooth acted as a stop when the musician pressed the string toward the fingerboard at a point below the apex. In addition, this sawtooth fingerboard allowed the musician to slide his finger on the fingerboard toward the bridge in a smooth motion. However, the point of contact of the fingerboard with the string was the sharp edge of the apex of the sawtooth and the high pressure at the point of contact resulted in severe wear along that edge. The wear resulted in a shifting of the stop position toward the nut, similar to the effect of wear in a conventional fret. Further, the musician could only slide his fingers comfortably on the fingerboard toward the bridge, since the short jags caught the fingers when the musician tried to slide toward the nut. This sawtooth fingerboard was not a commercial success and it is believed that it is no longer available to the public.

SUMMARY OF INVENTION

It is therefore an object of this invention to provide an improved fingerboard for stringed musical instruments.

It is a further object of this invention to provide a fingerboard for stringed instruments which produces an improved sound.

It is a further object of this invention to provide such a fingerboard which provides for easier fingering of the instrument.

It is a further object of this invention to provide such a fingerboard on which the contact with a string produces stop positions which coincide with fret positions.

It is a further object of this invention to provide such a fingerboard which reduces the shift of the stop position due to wear.

It is a further object of this invention to provide such a fingerboard for which the results of wear may be repaired easily and without the eventual need to replace the fingerboard.

It is a further object of this invention to provide such a fingerboard which allows musicians to play faster.

It is a further object of this invention to provide such a fingerboard having effective fret stops which produce a sound similar to that of jumbo or super jumbo frets.

It is a further object of this invention to provide such a fingerboard which reduces the pull-on noise.

It is a further object of this invention to provide such a fingerboard which is easy to manufacture.

It is a further object of this invention to provide such a fingerboard which reduces the noise produced in stretching or bending a string.

This invention results from the realization that an improved fingerboard establishing discrete string stops may be accomplished by providing a series of generally planar raised surfaces traversing the fingerboard separated by desired intervals and having recessed surfaces between them which are inclined to form a junction with the edges of the raised surfaces disposed toward the nut of the instrument fret, and the further realization that by making the raised surfaces of a very hard material and employing an edge of the hard surface as the stop position the effects of wear may be reduced and there is very little shift in the stop position.

This invention features a plurality of fingerboard sections, each including a substantially planar raised surface and a recessed surface on a fingerboard. The raised surfaces include fret edges disposed toward the nut of the instrument and located at fret positions along the strings of the instrument. The recessed surfaces are at least partially inclined to verge upon the fret edges of the raised surfaces. The recessed surfaces may include indicator means including a visual marker such as a surface marker proximate the edge of a raised surface or an insert adjacent to the fret block to provide a visual indication of the fret position proximate the raised surface.

The raised surfaces may be provided by a plurality of substantially rectangular blocks called fret blocks placed cross-wise on the fingerboard. The fret blocks are spaced at fret intervals and separated by at least partly inclined recesses which verge upon the fret edges of the fret blocks to create string stops at the junction of the recessed surfaces and the raised surfaces. The fret blocks may be of a material which gives the raised surfaces a hardness of 88 Shore D or greater and may be made of silica- and carbon-bearing epoxy. Alternatively, the fingerboard and the raised and recessed surfaces may be integrally formed from a monolithic structure. The recessed surfaces may have portions which incline to verge upon the fret edges of raised surfaces at an angle of approximately 5–7°. The recessed surfaces may be substantially planar or may be curved, angled or otherwise nonplanar. Fret intervals may narrow as they progress toward the bridge of the instrument. The raised surfaces may encompass approximately 25% of the width of the fret interval in which they are disposed, or some or all of the raised surfaces may be equal.

DISCLOSURE OF PREFERRED EMBODIMENT

Other objects, features and advantages will occur to from the following description of a preferred embodiment and the accompanying drawings, in which.

Figure 1:
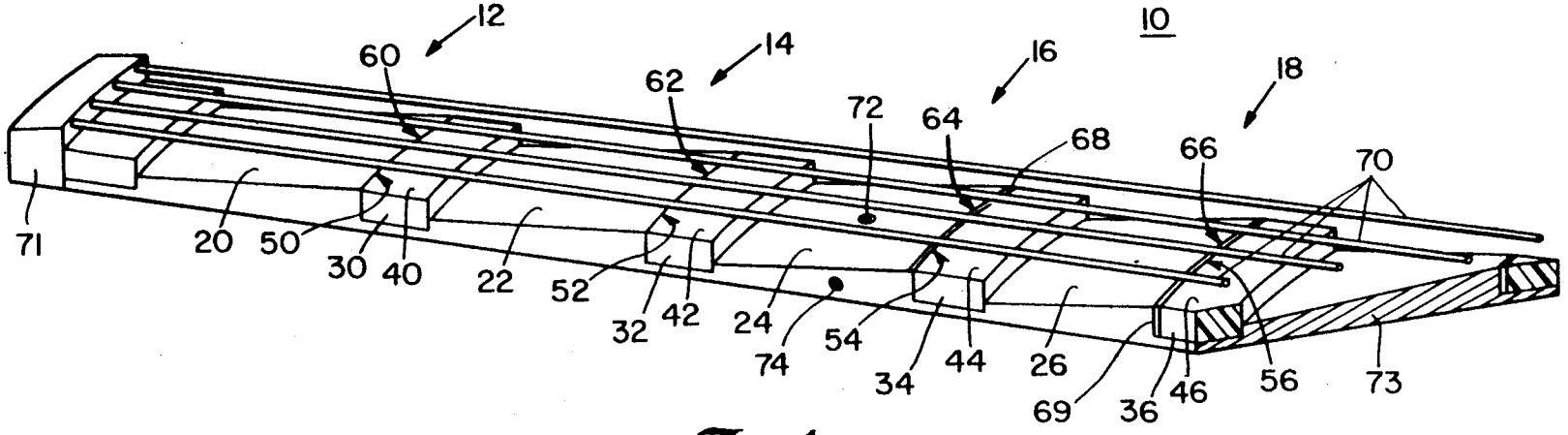
FIG. 1 is a perspective view of a fingerboard and suspended strings, according to this invention.

There is shown in FIG. 1, fingerboard 10, according to this invention, including fingerboard sections 12, 14, 16 and 18 on monolithic member 73. The fingerboard sections include recessed inclined surfaces 20, 22, 24, and 26 and raised surfaces 40, 42, 44, and 46, which are substantially planar: they may be slightly curved in an arc traverse to the longitudinal axis of the fingerboard as is common for fingerboards on stringed instruments. The raised surfaces include fret edges 50, 52, 54, and 56 disposed toward nut 71 on the instrument and may be provided by fret blocks 30, 32, 34 and 36 attached to monolithic member 73. Recessed inclined surfaces 20, 22, 24 and 26 verge upon fret edges 50, 52, 54 and 56 respectively to form junctions which create string stops 60, 62, 64 and 66 when strings 70 are pressed into contact with the fingerboard. Indicator means may be positioned to coincide with the junction of the recessed surface and raised surfaces to indicate the positions of string stops. For example, there may be a surface marking or inlay 68 such as shown at stop 64 or a more substantial structure such as insert 69, shown at stop 66.

Generally a fingerboard, according to this invention, will include recessed surfaces either uniformly excluding indicator means or uniformly including indicator means. For convenience, however, FIG. 1 shows fingerboard 10 with recessed surfaces 20, 22 excluding indicator means and recessed surfaces 24 and 26 including indicator means. Fingerboard 10 may also include conventional position markers 72 and 74 placed as customary or as desired.

Raised surfaces 40, 42, 44, 46 have a hardness of 88 Shore D or higher. This may be accomplished by fabricating fret blocks 30, 32, 34, 36 out of a silica and carbon bearing epoxy, available from Polychem Corporation. The epoxy surface is advantageous in that when the surface wears down after prolonged use additional epoxy may be applied to the fret block and easily ground and sanded to replicate the original raised surface. This repair process is inexpensive and may be performed repeatedly without damage to the fingerboard. Recessed surfaces 20, 22, 24 and 26 may be softer than the raised surfaces and be made of wood or a thermoplastic material.

Figure 2:
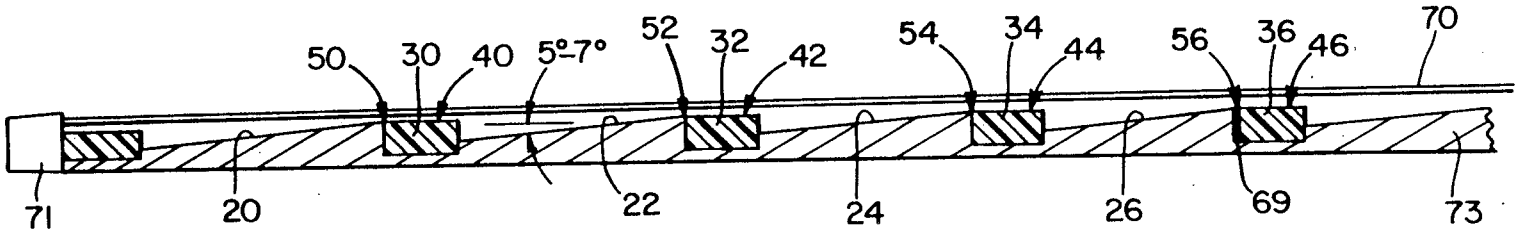
FIG. 2 is a longitudinal cross-sectional view of the fingerboard of FIG. 1.

Recessed surfaces 20, 22, 24 and 26 are inclined at an angle of 5 to 7° as shown in FIG. 2 to verge upon fret edges 50, 52, 54 and 56 of fret blocks 30, 32, 34 and 36.

Figure 3:
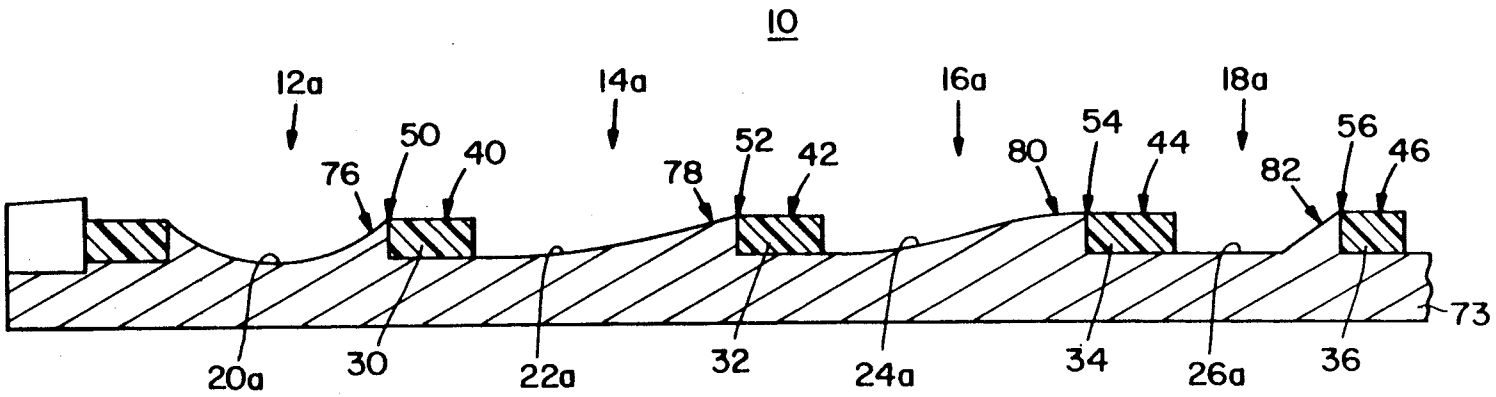
FIG. 3 is a cross-sectional view of a fingerboard according to this invention illustrating variously curved and angled recessed surfaces.

While FIG. 2 shows recessed surfaces 20, 22, 24, 26 as having a common contour, i.e., substantially planar, this is not necessarily a limitation of this invention. Fingerboard 10 may include fingerboard sections 12a, 14a, 16a and 18a, FIG. 3 which include curvilinear and angular recessed surfaces 20a, 22a, 24a and 26a, respectively. This illustrates that recessed surfaces may have any contour provided they include partly inclined sections 76, 78, 80 and 82 to verge upon fret edges 50, 52, 54 and 56, respectively, and do not exceed the height of raised surfaces 40, 42, 44, and 46.

Figure 4:
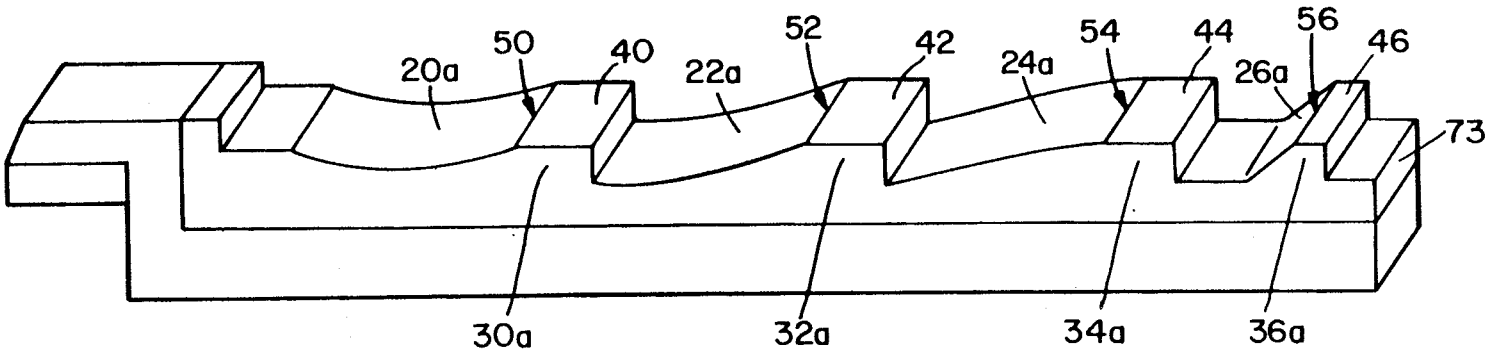
FIG. 4 is a perspective view of a fingerboard according to this invention formed as a monolithic unit.

While the previous figures and discussion show that raised surfaces 40, 42, 44 and 46 are provided by discrete fret blocks 30, 32, 34 and 36, this is not necessarily a limitation of this invention. As shown in FIG. 4, fret blocks may be integral with monolithic member 73.

Figure 5:
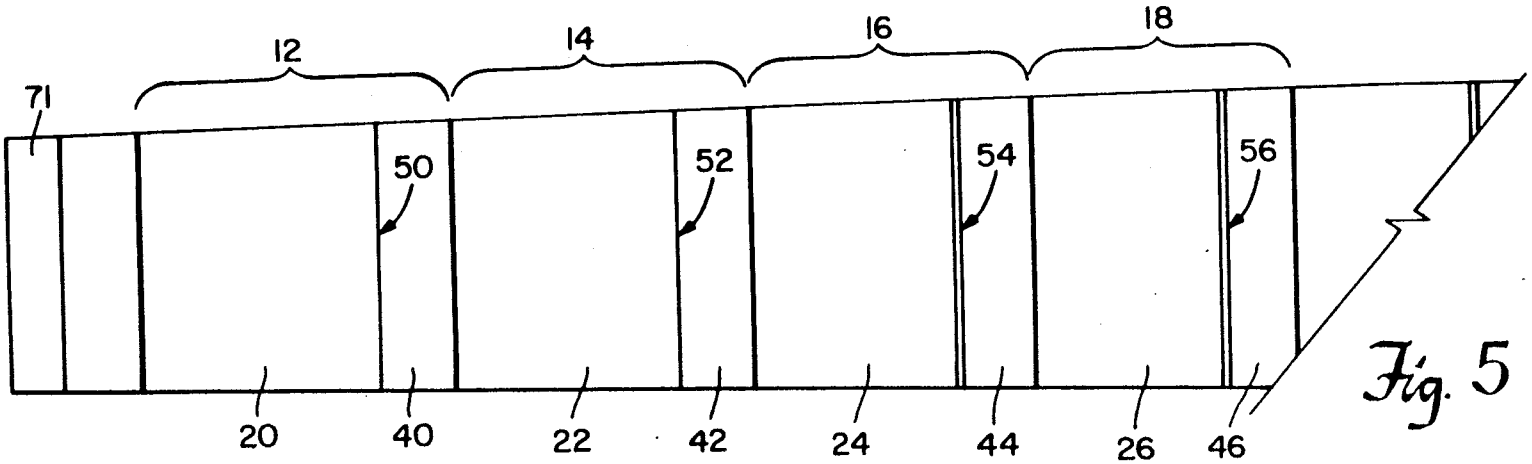
FIG. 5 is a top view of the fingerboard of FIG. 1 without the strings and with raised surfaces of even width.
Figure 6:
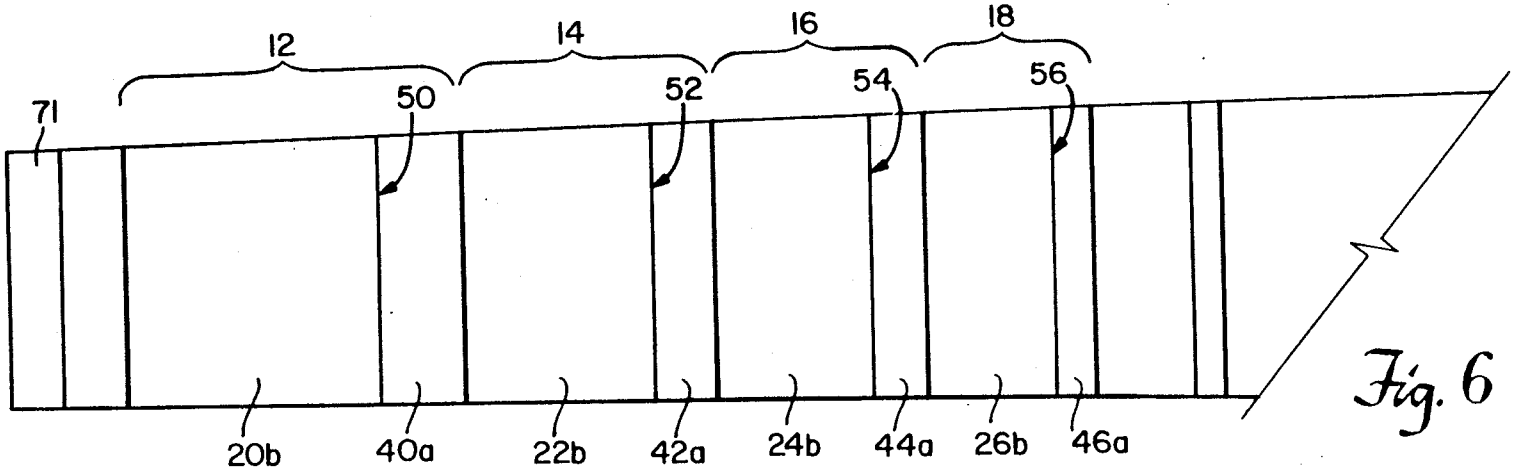
FIG. 6 is a top plan view of a fingerboard with raised surfaces of varying widths, according to this invention.

As shown in FIG. 5, fingerboard sections 12, 14, 16 and 18 become increasingly narrow as they approach the bridge of the instrument (not shown) and recede from nut 71. Raised surfaces 40, 42, 44 and 46 may have constant widths as shown in FIG. 5 and therefore occupy increasing proportion of fret fingerboard section 12, 14, 16 and 18, respectively. This allows the fabrication of a number of identical fret blocks and therefore simplifies the manufacturing process. Alternatively, fret blocks 40a, 42a, 44a, and 46a, FIG. 6 may decrease in width proportionately with recess surfaces 20a, 22a, 24a and 26a, respectively, so that paired recessed and raised surfaces maintain a constant relative proportion of the fingerboard sections in which they are disposed. It has been found that when raised surfaces 40a, 42a, 44a and 46a occupy approximately 25% of the fingerboard section in which they are disposed, a superior physical impedance is achieved for creating string stops and a very smooth glissando may be performed.

In use, the musician typically holds the stringed instrument with one hand placed on the neck to allow convenient access of his fingers to the fingerboard. To play a desired note the musician depresses any one of the strings 70, FIG. 1. For best results, the finger is placed on the string directly above a recessed surface 20, 22, 24 26. As the string is depressed toward the fingerboard it makes contact with an edge 50, 52, 54, 56 of raised surface 40, 42, 44, 46 at the juncture with a recessed surface 20, 22, 24, 26 and the musician thereby establishes a stop on an intermediate point of the string at string stops 60, 62, 64, 66. A string may be sounded by plucking, strumming or bowing, and is free to vibrate between the stop and the bridge of the instrument. To accomplish a sliding tone or glissando, the musician maintains the finger pressure which has brought the string into contact with the junction of the raised surface and recessed surface and moves the finger on the string toward the bridge for an ascending tone, or toward the nut for a descending tone. Since the raised surfaces may occupy approximately 25% of the space between stop positions, this sliding motion may be performed smoothly to give a smooth transition from one position to the next, thus providing a smooth glissando and minimum irritation of the musician's fingers.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A fingerboard for a stringed instrument, comprising:

a plurality of fingerboard sections each including a fret block having a hardness in the range of 88 Shore D or higher and made of silica and carbon bearing epoxy, each fret block having a raised surface substantially parallel to the fingerboard, and a fret edge; and recessed surfaces at least partially inclined to verge upon said fret edges.

2. The fingerboard of claim 1 wherein at least one of said recessed surfaces includes indicator means for providing a visual indication of the fret position of the adjacent raised surface.

3. The fingerboard of claim 2 wherein said indicator means includes a surface mark on at least one of said recessed surfaces.

4. The fingerboard of claim 2 wherein said indicator means includes an insert positioned alongside one of said fret blocks.

5. The fingerboard of claim 1 wherein the widths of said raised surfaces are approximately 25% of the width of the fingerboard sections in which they are disposed.

6. The fingerboard of claim 1 wherein at least some of said fret blocks are of equal width.

7. The fingerboard of claim 1 wherein each said recessed surface is inclined at an angle of 5°–7 ° relative to the raised surface of said fret block.

8. The fingerboard of claim 1 wherein said recessed surfaces are substantially planar.

9. The fingerboard of claim 1 wherein said recessed surfaces are nonplanar.

10. The fingerboard of claim 1 wherein each said fret edge corresponds to a fret position of the instrument strings.

11. A fingerboard for a stringed instrument, comprising:

a plurality of fingerboard sections each including a fret block having a fret edge and a raised surface substantially parallel to the fingerboard and being approximately 25% of the width of the fingerboard section in which it is disposed; and recessed surfaces at least partially inclined to verge upon said fret edges.

12. The fingerboard of claim 11 wherein each said recessed surface is inclined at an angle of 5°–7 ° relative to the raised surface of said fret block.

13. The fingerboard of claim 11 wherein said recessed surfaces are substantially planar.

14. The fingerboard of claim 11 wherein said recessed surfaces are non-planar.

15. The fingerboard of claim 11 wherein each said fret edge corresponds to a fret position of the instrument strings.

16. The fingerboard of claim 11 wherein said fret blocks have a hardness in the range of 88 Shore D or higher.

17. The fingerboard of claim 11 wherein said fret blocks are made of silica- and carbon-bearing epoxy.

* * * * *